US005772137A

United States Patent [19]

Gilbos et al.

[11] Patent Number: 5,772,137

[45] Date of Patent: Jun. 30, 1998

[54] YARN MONITOR FOR AUTOMATIC CROSS WINDING AND ASSEMBLY MACHINES

[75] Inventors: Erik Gilbos, Dikkelvenne; Emiel Rubbrecht, Iddergem; Christian Van Hautte, Wannegem-Lede; Tom Jacobs, Dendermonde, all of Belgium

[73] Assignee: Textielmachinefabriek Gilbos N.V., Belgium

[21] Appl. No.: 731,440

[22] Filed: Oct. 15, 1996

[30] Foreign Application Priority Data

Oct. 16, 1995 [BE] Belgium ..... 09500861

[51] Int. Cl.[6] ..... B65H 54/00

[52] U.S. Cl. ..... 242/42; 242/18 DD; 242/19; 242/35.6 E; 242/35.6 R

[58] Field of Search ..... 242/19, 18 R, 242/18 DD, 35.6 E, 35.6 R, 42

[56] References Cited

U.S. PATENT DOCUMENTS

| | | | |
|---|---|---|---|
| 5,188,304 | 2/1993 | Colli et al. | 242/35.6 R |
| 5,301,886 | 4/1994 | Kathke et al. | 242/35.6 E |
| 5,348,238 | 9/1994 | Yamauchi et al. | 242/18 R |
| 5,605,296 | 2/1997 | Haasen et al. | 242/35.6 E |

FOREIGN PATENT DOCUMENTS

| | | | |
|---|---|---|---|
| 4025696 | 2/1992 | Germany | 242/19 |
| 4241290 | 6/1993 | Germany | 242/18 DD |
| 17773 | 1/1988 | Japan | 242/19 |

*Primary Examiner*—William Stryjewski
*Attorney, Agent, or Firm*—William A. Drucker

[57] ABSTRACT

A yarn monitor for an automatic cross winding and yarn assembly machine in which at least two yarns are wound in parallel from two run-off bobbins onto a cross bobbin. The monitor includes a drive roller for driving round the cross bobbin, a driver for rotating the drive roller in two opposite directions and a wind-off eye for leading the two yarns to the cross bobbin. A yarn guide is provided for axially guiding the yarns on the cross bobbin, the yarn guide being installed between the cross bobbin and the wind-off eye for controlling and correcting the position of the two yarns with respect to one another. The yarn guide comprises a cutting apparatus for cutting at least one of the yarns and a driver for the cutting apparatus. A yarn guide is provided for guiding the yarns co-operating with the cutting apparatus. Sensors are provided for detecting the yarns in the yarn guide and for controlling the cutting apparatus. Guiding apparatus is provided for putting the yarns into the cutting apparatus and the yarn guide. A gripper and holder is provided for gripping and holding the yarn ends left after cutting on the cross bobbin and a central control device is provided for controlling all the apparatus.

6 Claims, 2 Drawing Sheets

YARN MONITOR FOR AUTOMATIC CROSS WINDING AND ASSEMBLY MACHINES

BACKGROUND OF THE INVENTION

1. Field of the Invention

The invention is for a yarn monitor for an automatic cross winding and assembly machine, whereby at least two parallel yarns are wound crosswise on a cross bobbin.

2. Brief Description of the Prior Art

In assembly machines which also clean the yarns unwinding from the run-off bobbins spinning defects may occur, making it necessary to remove the spinning defect by cutting, grip the resulting yarn ends on the cross bobbin or suck them up, whereby the cross bobbin will for this purpose have to be turned in the direction opposite to the winding direction and then aforesaid yarn ends will have to be joined to those of the yarns coming from the run-off bobbins.

When no problems occur during the sucking up of the yarn ends onto the cross bobbin or during the simultaneous cutting of the yarns, the yarn ends requiring joining are gripped or sucked up in phase or together as a single bundle from the cross bobbin.

When, however, the yarn end of one of the yarns is gripped or sucked later than the other yarn end from the cross bobbin, where the cross bobbin has already made one or more turns, there is difference in length between the yarns which is equal to one or more times the circumference of the cross bobbin, so that defects, such as breaking, may arise later on during the yarn twisting process.

SUMMARY OF THE INVENTION

One purpose of the invention is to detect and to eliminate automatically aforesaid defect, so that it is possible to assembly and to clean automatically yarns, while no iregularities may arise later on during the yarn twisting process.

BRIEF DESCRIPTION OF THE DRAWINGS

By way of example, and without in any way being exhaustive, a description is given of a preferred embodiment of the monitor with associated components in accordance with the invention and intended in this case for checking the yarn ends of two parallel yarns. This description refers to the attached drawings, where.

DESCRIPTION OF THE PREFERRED EMBODIMENT

Figure 1:
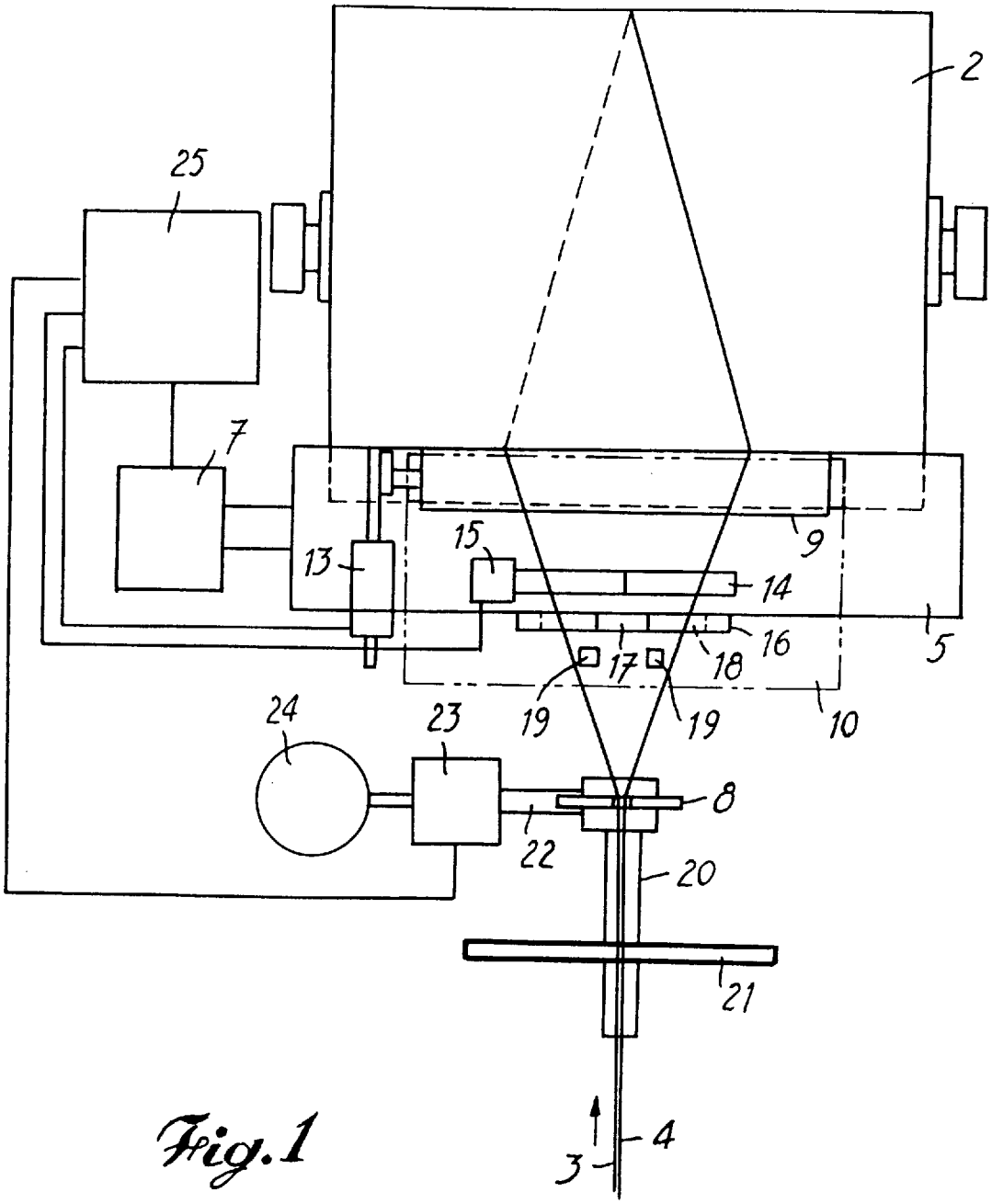
FIG. 1 shows a schematic front elevation of the entire installation with yarn monitor.
Figure 2:
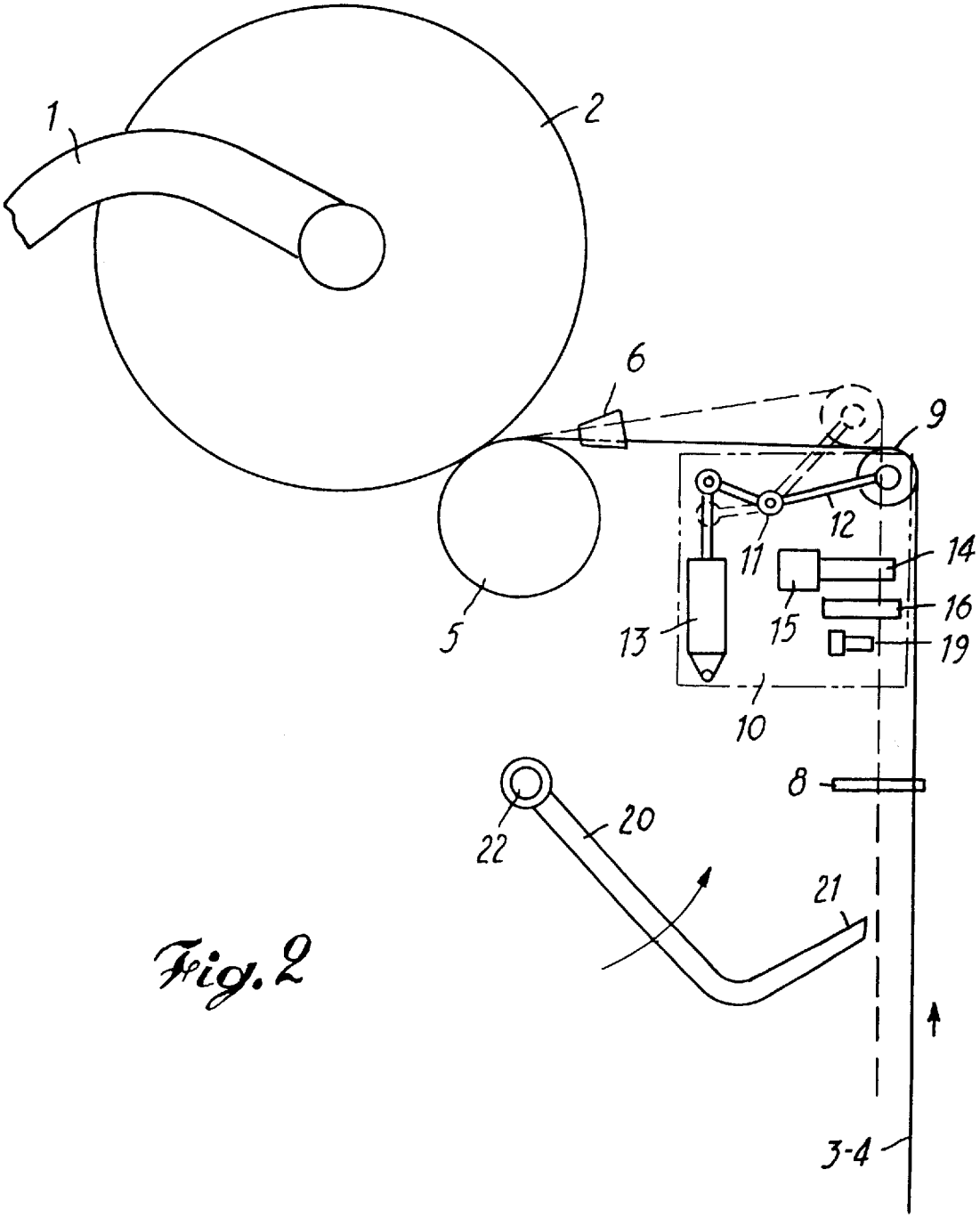
FIG. 2 shows a side elevation of the same.

In these figures will be noted a cross bobbin 2 suspended in a cross bobbin holder and on which in this case two yarns 3–4 requiring simultaneous winding are being wound crosswise. The cross bobbin is driven round and can be turned back with one or more turns by a drive roller 5, while yarns are moved axially over the cross bobbin by a yarn guide 6. The drive roller is driven by a driving means 7. The yarns wound off the run-off bobbins (not shown) are normally passed through a wind-off eye 8 and over a guide roller 9 which forms part of the yarn monitor 10 installed between the cross bobbin 2 and the wind-off eye. Aforesaid guide roller 9 is mouinted on an arm 12 which swivels around a spindle 11. The free end of this arm is connected to a compressed air cylinder 13 for the purpose of swivelling the arm. One or more cutting means 14 with drive 15 are provided in the yarn monitor 10, as well as a yarn guide 16 with an entry gap 17 and an rectangular hole 18 with two ends, and sensors 19 for detecting the yarns 3–4. For the simultaneous or phase sucking up of the yarn ends of yarns 3–4 onto the cross bobbin 2, a suction tube 20 with suction intake 21 is provided, which suction intake can swivel around a spindle 22 by means of a driving 23. The sucking power in the suction pipe is provided by a vacuum system 24. A control device 25 for controlling the entire installation is provided and driving means 7–15–23 and the compressed air cylinder 13 are connected to same.

When a defect is detected in yarns 2–3, the yarns are cut through by a known device (not shown), so that the remaining yarn ends from the cross bobbin are wound up on same and the control device 25 receives a signal. At the same time the control device sends a signal to the driving means 7 which stops the drive roller 5 and cross bobbin 2. Thereafter the control device activates driving means 23 of the suction tube 20 which then swivels round the spindle 22 until the suction intake 21 is in front of the cross bobbin 2. The control device then gives a signal to the driving means 7 which causes the drive roller 5 and the cross bobbin 2 to turn in the direction contrary to the winding direction of the cross bobbin, so that the suction intake 21 which works in conjunction with the vacuum system 24, can easily suck up the yarn ends on the cross bobbin 2 while it is being unwound. After this the control device 25 causes the driving means 23 to make the suction tube 20 swivel around its spindle 22 to its initial position, so that the yarns 3–4 are positioned in the winding off eye 8. The control device also activates the compressed air cylinder 13, which swivels round spindle 11 by means of swivel arm 12, and which moves guide roller 9 upwards in such a way that the yarns are placed in the yarn monitor 10 in which the cutting means 14 for cutting one of the sucked up yarns, the yarn guide 16 and the sensors 19 are located. At the same time the yarns ends are positioned in a known way in a joining device (not shown) in which they are joined together by tangling or splicing.

When both yarns 3–4 are extracted simultaneously or in phase these yarns move during the further unwinding of the yarns from the cross bobbin from the one end to the other of the hole 18 of the yarn guide 16. In doing so the sensors 19 will detect yarns in turn and pass on a signal to the control device 24, enabling them to determine that the extraction has taken place correctly.

When, however, the yarns do not run in parallel or are not extracted in phase, one of the yarns being for example extracted one revolution earlier than the other yarn, will race ahead of the other yarn over a distance equal to the pitch of the assembled yarn bundle on the cross bobbin. As a result the two yarns 3–4 will no longer move synchronously in the hole 18 of the yarn guide 16, so that the sensors 19 indicate to the control device 24 that the two yarns are not being extracted simultaneously or in phase. The racing yarn will then be cut by the cutting means 14, and cross bobbin 2 will be rewound with a length equal to one revolution of the cross bobbin plus the distance between the cutting means 14 and the cross bobbin 2. After this the suction intake 21 will again be moved upwards in order to grip the cut yarn end.

It goes without saying that the parts described here above could be replaced by others which serve the same purpose and that also their mutual configuration may differ.

We claim:

1. A yarn monitor for an automatic cross winding and yarn assembly machine in which at least two yarns are wound in parallel from two run-off bobbins onto a cross bobbin, said cross bobbin having an axis and a wind-off eye for leading the two yarns to the cross bobbin, said monitor disposed between the cross bobbin and the wind-off eye for controlling and correcting the position of the two yarns with respect to one another, including:

a drive roller for driving said cross bobbin, driving means for rotating said drive roller in two opposite directions, a yarn guide for guiding said yarns on the cross bobbin axially of the cross bobbin;

cutting means for cutting at least one of said yarns, driving means for driving the cutting means to produce a cutting movement of said cutting means, a yarn guide for guiding said yarns in cooperation with the cutting means to guide said yarns in position to be cut by said cutting means, sensors for detecting said yarns in said yarn guide and for controlling said cutting means, guiding means for putting said yarns into the cutting means and the yarn guide, means for gripping and holding the yarn ends left on the cross bobbin after cutting by the cutting means when the yarns do not run in parallel, and a central control device for controlling all the said means.

2. Yarn monitor in accordance with claim 1 wherein the yarn guide for the cuttings means has an entry gap and a hole with two ends in which the yarns move back and forth.

3. Yarn monitor in accordance with claim 1 wherein two sensors are provided for the yarns coming from the cross bobbin.

4. Yarn monitor in accordance with claim 1 wherein the means for gripping and holding the yarn ends after cutting comprises a spindle, a suction tube swivelling around the spindle and a suction intake for sucking up the cut yarn ends on the cross bobbin.

5. Yarn monitor in accordance with claim 1 wherein the means for putting the yarns into the yarn guide of the yarn monitor comprises a guide roller mounted on a swivel arm and over which the yarns are guided and a compressed air cylinder to move the swivel arm with the guide roller.

6. Yarn monitor in accordance with claim 1 wherein the cutting means is provided with means to cut off a lagging yarn which is running slower than the other yarn, after unwinding these yarns by the driving means which is provided with means to turn the cross bobbin through one revolution plus the distance between the cross bobbin and the cutting means in the same direction as the winding direction of the cross bobbin.

* * * * *